US009791806B1

(12) United States Patent
Cavill et al.

(10) Patent No.: US 9,791,806 B1
(45) Date of Patent: Oct. 17, 2017

(54) DEVELOPER ROLL HAVING MAGNETIC ZONES OF VARYING AXIAL LENGTH FOR A DUAL COMPONENT DEVELOPMENT ELECTROPHOTOGRAPHIC IMAGE FORMING DEVICE

(71) Applicant: LEXMARK INTERNATIONAL, INC., Lexington, KY (US)

(72) Inventors: Gregory Alan Cavill, Winchester, KY (US); Gary Allen Denton, Lexington, KY (US); Matthew Lee Rogers, Lexington, KY (US); Katherine Marie Gilliam, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/137,042

(22) Filed: Apr. 25, 2016

(51) Int. Cl.
*G03G 15/08* (2006.01)
*G03G 15/09* (2006.01)

(52) U.S. Cl.
CPC ..... *G03G 15/0928* (2013.01)

(58) Field of Classification Search
CPC ..... G03G 15/0928
USPC ..... 399/277
See application file for complete search history.

(56) References Cited

U.S. PATENT DOCUMENTS

| | | | | |
|---|---|---|---|---|
| 9,152,089 | B1 | 10/2015 | Denton et al. | |
| 9,188,907 | B1 | 11/2015 | Bennett, III et al. | |
| 2006/0198655 | A1* | 9/2006 | Kotera | G03G 15/0921 399/104 |
| 2011/0150525 | A1* | 6/2011 | Fujiwara | G03G 15/0822 399/111 |
| 2012/0201577 | A1* | 8/2012 | Sakamaki | G03G 15/0921 399/286 |

FOREIGN PATENT DOCUMENTS

| | | | | |
|---|---|---|---|---|
| JP | 2004327871 | A * | 11/2004 | |
| JP | 2008089730 | A * | 4/2008 | G03G 15/0942 |

* cited by examiner

*Primary Examiner* — Quana M Grainger
(74) *Attorney, Agent, or Firm* — Justin M. Tromp

(57) ABSTRACT

A developer roll according to one example embodiment includes a core including at least one permanent magnet forming a magnetized portion of the core. A cylindrical sleeve positioned around the core is rotatable relative to the core about an axis of rotation in an operative rotational direction. A release pole of the permanent magnet is positioned to magnetically attract developer mix to an outer circumferential surface of the sleeve to transport developer mix on the surface of the sleeve in the operative rotational direction when the sleeve rotates relative to the core to a release point where a magnetic field of the permanent magnet is insufficient to retain developer mix against the surface of the sleeve. An axial length of the magnetized portion of the core decreases at both axial ends of the core as the magnetized portion of the core approaches the release point in the operative rotational direction.

18 Claims, 8 Drawing Sheets

DEVELOPER ROLL HAVING MAGNETIC ZONES OF VARYING AXIAL LENGTH FOR A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to a developer roll having magnetic zones of varying axial length for a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A developer roll includes a stationary core having one or more permanent magnets and a sleeve that rotates around the core. The permanent magnet(s) produce a series of magnetic poles that are circumferentially spaced around the outer surface of the sleeve. The magnetic poles attract the carrier beads in the reservoir having toner thereon to the outer surface of the sleeve, which transports the developer mix as the sleeve rotates. A photoconductive drum is charged by a charge roll to a predetermined voltage and a laser selectively discharges areas on the surface of the photoconductive drum to form a latent image on the surface of the photoconductive drum. The sleeve of the developer roll carries the developer mix in close proximity to the photoconductive drum. The sleeve is electrically biased to facilitate the transfer of toner from the chains of developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet. Developer mix on the outer surface of the sleeve that is not transferred to the photoconductive drum is transported by the sleeve back to the reservoir. After the remaining developer mix reenters the reservoir, the developer mix is no longer magnetically retained against the outer surface of the sleeve allowing the developer mix to release from the sleeve back into the reservoir.

In general, the sleeve of the developer roll has a greater axial length than the core such that axial end portions of the sleeve extend past both axial ends of the core. The magnetic field lines from the core extend past the axial ends of the core and attract fine amounts of developer mix to the surface of the sleeve past the axial ends of the core. Developer mix on the surface of the sleeve past the axial ends of the core is generally not dense enough to form full quality images on the surface of the photoconductive drum. Accordingly, transfer of toner from the developer mix on the surface of the sleeve past the axial ends of the core to the surface of the photoconductive drum at the outer axial portions of the photoconductive drum is undesired.

The presence of unwanted developer mix on the surface of the sleeve past the axial ends of the core also increases the risk of leakage of developer mix from the system. During operation, developer mix may tend to accumulate on the outer axial end portions of the sleeve and leak past the axial ends of the sleeve potentially contaminating other parts of the system.

One method to reduce the unwanted transfer of toner from the surface of the sleeve past the axial ends of the core to the surface of the photoconductive drum includes extending the length of the charge roll in order to charge the surface of the photoconductive drum at the outer axial ends of the photoconductive drum past the axial ends of the core to a voltage that will resist the charged toner. However, increasing the length of the charge roll does not address the leakage risk and may increase the size and cost of the system.

Another method to reduce the unwanted transfer of toner from the surface of the sleeve past the axial ends of the core to the surface of the photoconductive drum includes placing a magnetic shunt axially outboard of each axial end of the core. Each magnetic shunt is composed of a magnetically permeable metal that redirects the magnetic field lines from the axial ends of the core back into the core to decrease the distance that the magnetic field lines extend axially past the core. As a result, the magnetic shunts decrease the distance the developer mix on the surface of the sleeve extends past the axial ends of the core thereby reducing the required length of the charge roll. However, the magnetic shunts may not sufficiently address the leakage risk.

One method to reduce leakage of developer mix at the axial ends of the sleeve includes positioning a magnetic seal in close proximity to the surface of the sleeve axially outboard of each magnetic shunt to capture any developer mix that leaks axially outward past the magnetic shunts. The magnetic seals are composed of permanent magnets that attract the developer mix to the seals. The magnetic seals must be positioned far enough axially outboard from the developer mix that is released from the sleeve back into the reservoir, otherwise the magnetic seals can become contaminated with the released developer mix limiting their sealing effectiveness. As a result, the magnetic seals may increase the size of the system.

Accordingly, an improved method to reduce the amount of carrier beads and toner on the surface of the sleeve of a developer roll past the axial ends of the core of the developer roll and to reduce developer mix leakage while minimizing the size of the system is desired.

SUMMARY

A developer unit for a dual component development electrophotographic image forming device according to one example embodiment includes a housing having a reservoir for storing a developer mix that includes toner and magnetic carrier beads. A developer roll is mounted on the housing. The developer roll includes a stationary core and a cylindrical sleeve positioned around the core. The core includes at least one permanent magnet forming a magnetized portion of the core that includes a plurality of circumferentially spaced magnetic poles. The plurality of magnetic poles includes a release pole. The sleeve is rotatable relative to the core about an axis of rotation in an operative rotational direction. The core includes a pair of axial ends relative to the axis of rotation. An outer circumferential surface of the sleeve is positioned to transport developer mix magnetically attracted from the reservoir to the outer surface of the sleeve by the magnetized portion of the core in the operative rotational direction. The release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir. An axial length of the magnetized portion of the core decreases at both axial ends of the core as the magnetized portion of the core approaches the release point in the operative rotational direction.

A developer roll for transporting a developer mix that includes magnetic carrier beads and toner in a dual component development electrophotographic image forming device according to another example embodiment includes a core including at least one permanent magnet forming a magnetized portion of the core that includes a plurality of circumferentially spaced magnetic poles generating a magnetic field. The plurality of magnetic poles includes a release pole. A cylindrical sleeve is positioned around the core. The sleeve is rotatable relative to the core about an axis of rotation in an operative rotational direction. The core includes a pair of axial ends relative to the axis of rotation. The release pole is positioned to magnetically attract developer mix to an outer circumferential surface of the sleeve to transport the developer mix on the outer circumferential surface of the sleeve in the operative rotational direction when the sleeve rotates relative to the core to a release point where a magnitude of a total magnetic field strength of the magnetic field falls below 15 mT at the outer circumferential surface of the sleeve. An axial length of the magnetized portion of the core decreases at both axial ends of the core as the magnetized portion of the core approaches the release point in the operative rotational direction.

A developer roll for transporting a developer mix that includes magnetic carrier beads and toner in a dual component development electrophotographic image forming device according to one example embodiment includes a core including at least one permanent magnet forming a magnetized portion of the core that includes a plurality of circumferentially spaced magnetic poles generating a magnetic field. The plurality of magnetic poles includes a release pole. A cylindrical sleeve is positioned around the core. The sleeve is rotatable relative to the core about an axis of rotation in an operative rotational direction. The core includes a pair of axial ends relative to the axis of rotation. The release pole is positioned to magnetically attract developer mix to an outer circumferential surface of the sleeve to transport the developer mix on the outer circumferential surface of the sleeve in the operative rotational direction when the sleeve rotates relative to the core to a release point where the magnetic field is insufficient to retain developer mix against the outer circumferential surface of the sleeve. An axial length of the magnetized portion of the core decreases at both axial ends of the core as the magnetized portion of the core approaches the release point in the operative rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
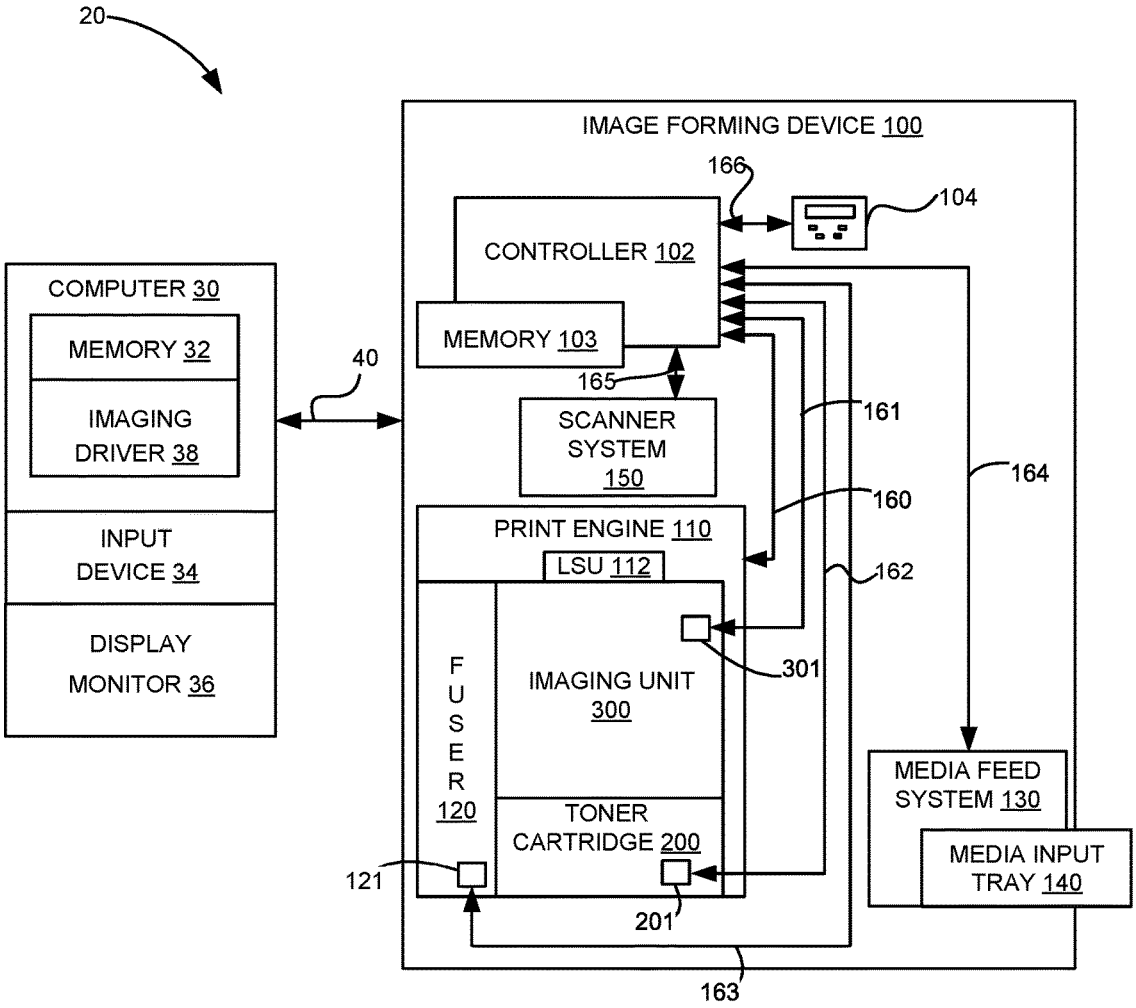
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103. The processor may include one or more integrated circuits in the form of a microprocessor or central processing unit and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
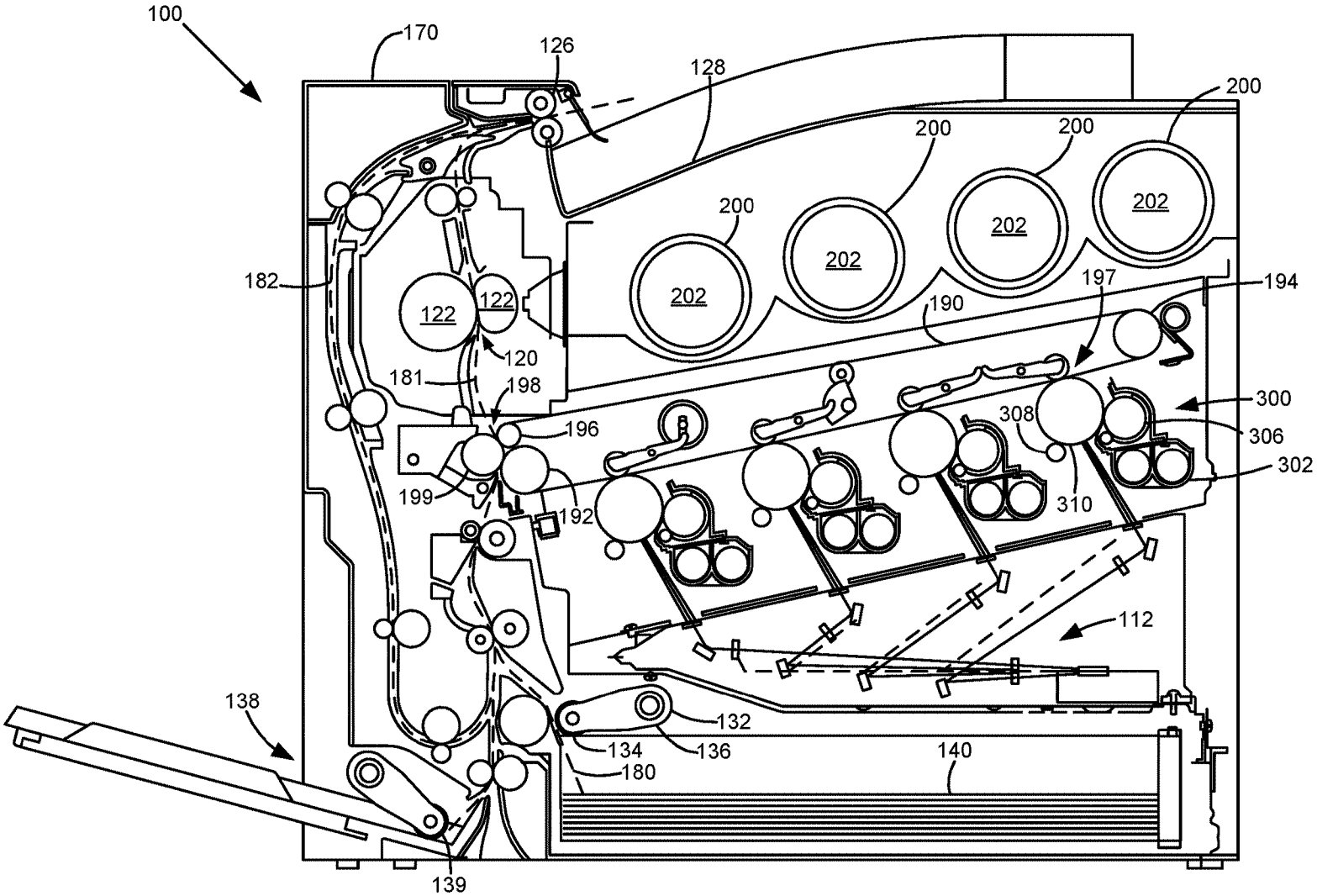
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a developer roll 306 collectively form a developer unit. Each imaging unit 300 also includes a charge roll 308, a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306 attracts the carrier beads in reservoir 302 having toner thereon to developer roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) may be replaceable collectively as desired.

Figure 3:
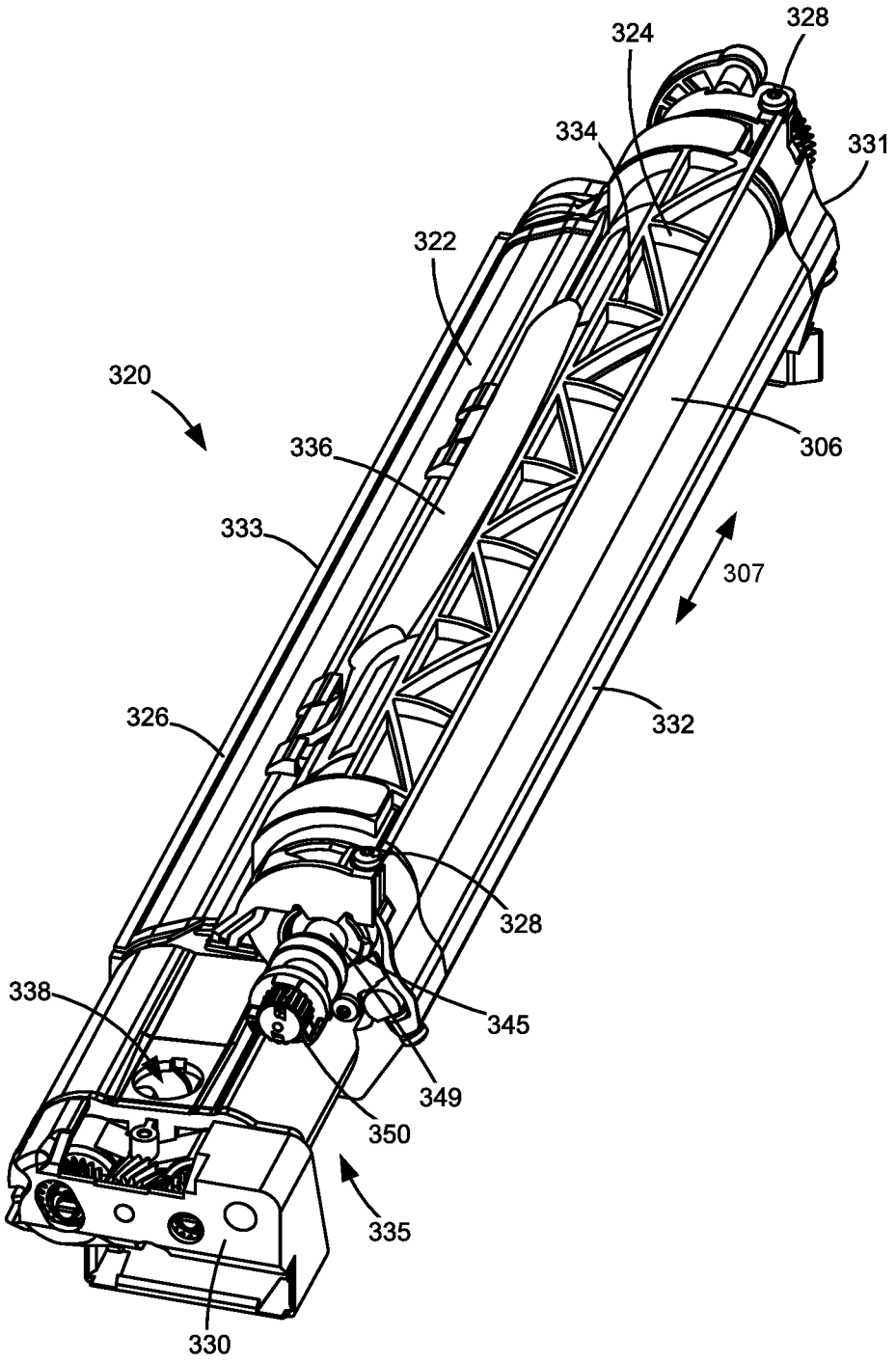
FIG. 3 is a perspective view of a developer unit according to one example embodiment.
Figure 4:
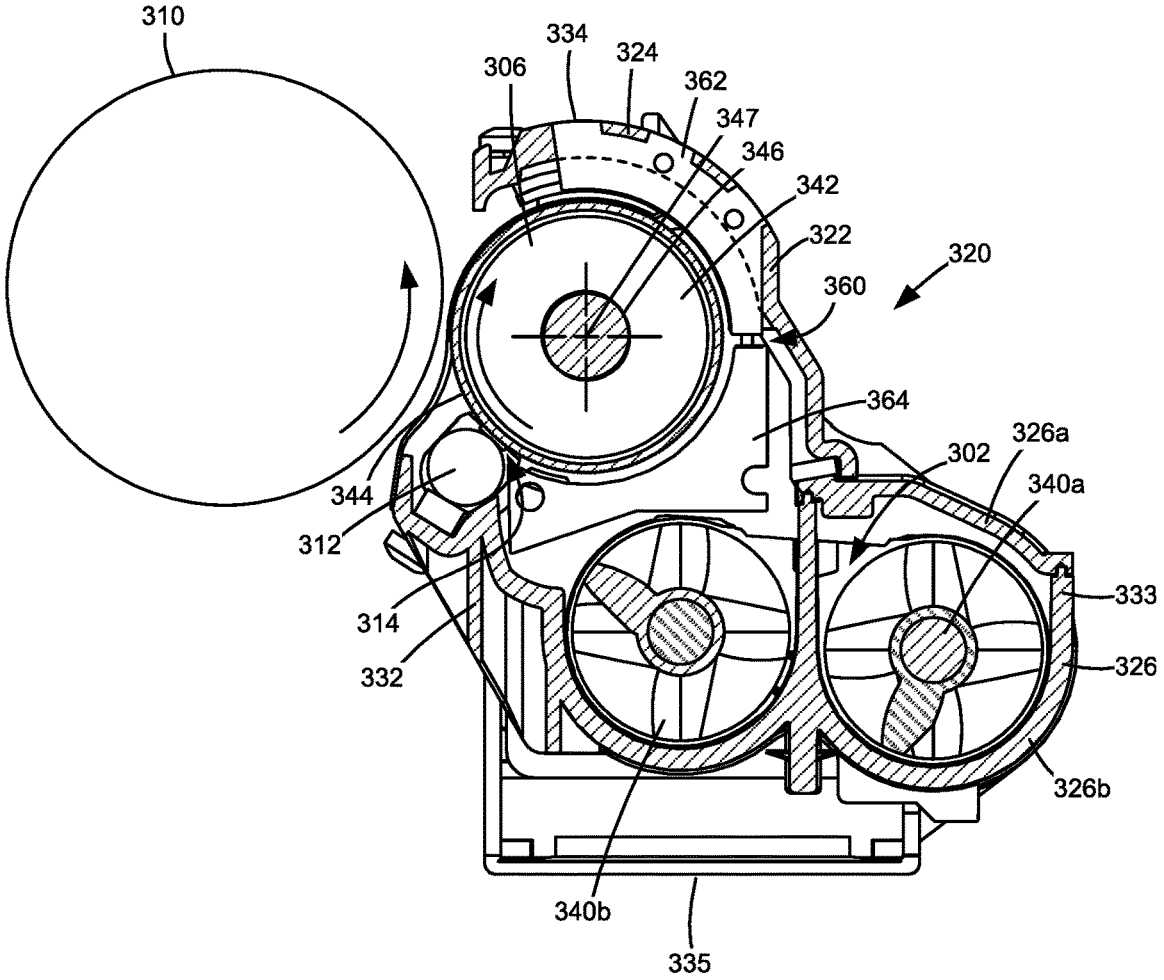
FIG. 4 is a cross-sectional view of the developer unit shown in FIG. 3.

FIG. 3 shows a developer unit 320 according to one example embodiment. Developer unit 320 includes a housing 322 having reservoir 302 therein. In some embodiments, housing 322 includes a lid 324 mounted on a base 326. Lid 324 may be attached to base 326 by any suitable construction including, for example, by fasteners (e.g., screws 328), adhesive and/or welding. Alternatively, lid 324 may be formed integrally with base 326. In the example embodiment illustrated, base 326 includes a top portion 326*a* attached (e.g., by fasteners, adhesive and/or welding) to a lower portion 326*b* (FIG. 4). Alternatively, top portion 326*a* of base 326 may be formed integrally with lower portion 326*b* of base 326. Housing 322 extends generally along an axial dimension 307 of developer roll 306 from a first end 330 of housing 322 to a second end 331 of housing 322. End 330 leads during insertion of developer unit 320 into image forming device 100 and end 331 trails. A portion of developer roll 306 is exposed from reservoir 302 at a front 332 of housing 322. A handle 336 is optionally positioned on a rear 333 of housing 322 to assist with separating developer unit 320 from the corresponding PC unit. Housing 322 also includes a top 334 and a bottom 335.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near end 330; however, inlet port 338 may be positioned at any suitable location on housing 322.

With reference to FIG. 4, reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of developer roll 306. For example, auger 340*a* is positioned to incorporate toner from inlet port 338 and to move the developer mix away from end 330 and toward end 331. Auger 340*b* is positioned to move the developer mix away from end 331, toward end 330 and in proximity to the bottom of developer roll 306. This arrangement of augers 340*a*, 340*b* is sometimes informally referred to as a racetrack arrangement because of the circular path the developer mix in reservoir 302 takes when augers 340*a*, 340*b* rotate.

Developer roll 306 includes a core 342 that includes one or more permanent magnets and that does not rotate relative to housing 322. A cylindrical sleeve 344 encircles core 342 and extends along the axial length of developer roll 306. In one embodiment, a shaft 346 passes through the center of core 342 and defines an axis of rotation 347 of developer roll 306. Shaft 346 is fixed, i.e., shaft 346 does not rotate with sleeve 344 relative to housing 322, and controls the position of core 342 relative to sleeve 344 and to the other components of developer unit 320. With reference back to FIG. 3, a rotatable end cap 345 is positioned at one axial end of developer roll 306, referred to as the drive side of developer roll 306. End cap 345 is coupled to sleeve 344 such that rotation of end cap 345 causes sleeve 344 to rotate around core 342. Sleeve 344 rotates in a clockwise direction as viewed in FIG. 4 to transport the developer mix from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a spur gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
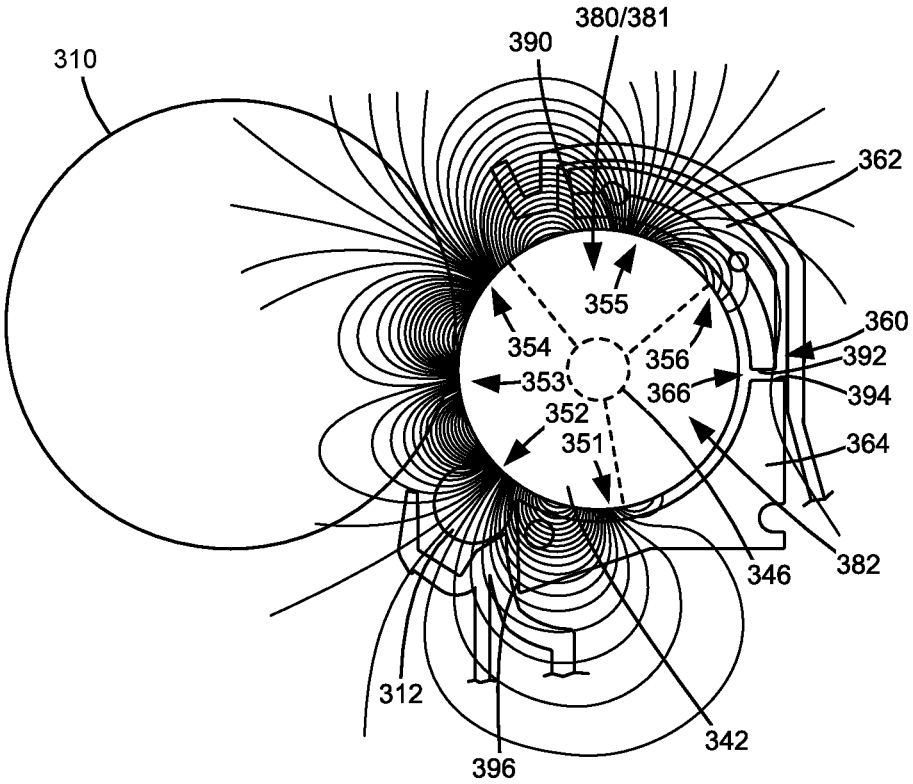
FIG. 5 is a schematic diagram of the developer unit of FIGS. 3 and 4 showing the magnetic field lines of a developer roll according to one example embodiment.

With reference to FIGS. 4 and 5, the permanent magnet(s) of core 342 produce a series of circumferentially spaced, alternating polarity (south v. north) magnetic poles 351-355 that facilitate the transport of developer mix to PC drum 310 as sleeve 344 rotates. A tangential component of the magnetic field of the permanent magnet(s) of core 342 is equal to zero at each pole 351-355. FIG. 5 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 5). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines. In one embodiment, the outer surface of sleeve 344 includes a series of radially indented grooves or is otherwise roughened. The grooves extend axially along the outer surface of sleeve 344 and are spaced circumferentially from each other about the outer surface of sleeve 344. The surface roughness of sleeve 344 promotes the formation of chains of developer mix with the bases of the chains tending to form in the grooves and minimizes slipping of the developer mix on the outer surface of sleeve 344.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Trim bar 312 may be electrically biased to aid in trimming the chains of developer mix. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by developer roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by developer roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to a release point 356 where the developer mix is released back into reservoir 302. At release point 356, the magnitude of the total magnetic field strength of core 342 decreases sufficiently (e.g., falls below 15 mT at the outer surface of sleeve 344) to allow the developer mix to separate from sleeve 344 and release back into reservoir 302. As the remaining developer mix passes the 2 o'clock position of core 342 as viewed in FIG. 5, the developer mix is no longer magnetically retained against sleeve 344 by core 342 allowing the developer mix to fall via gravity and centrifugal force back into reservoir 302.

Figure 6:
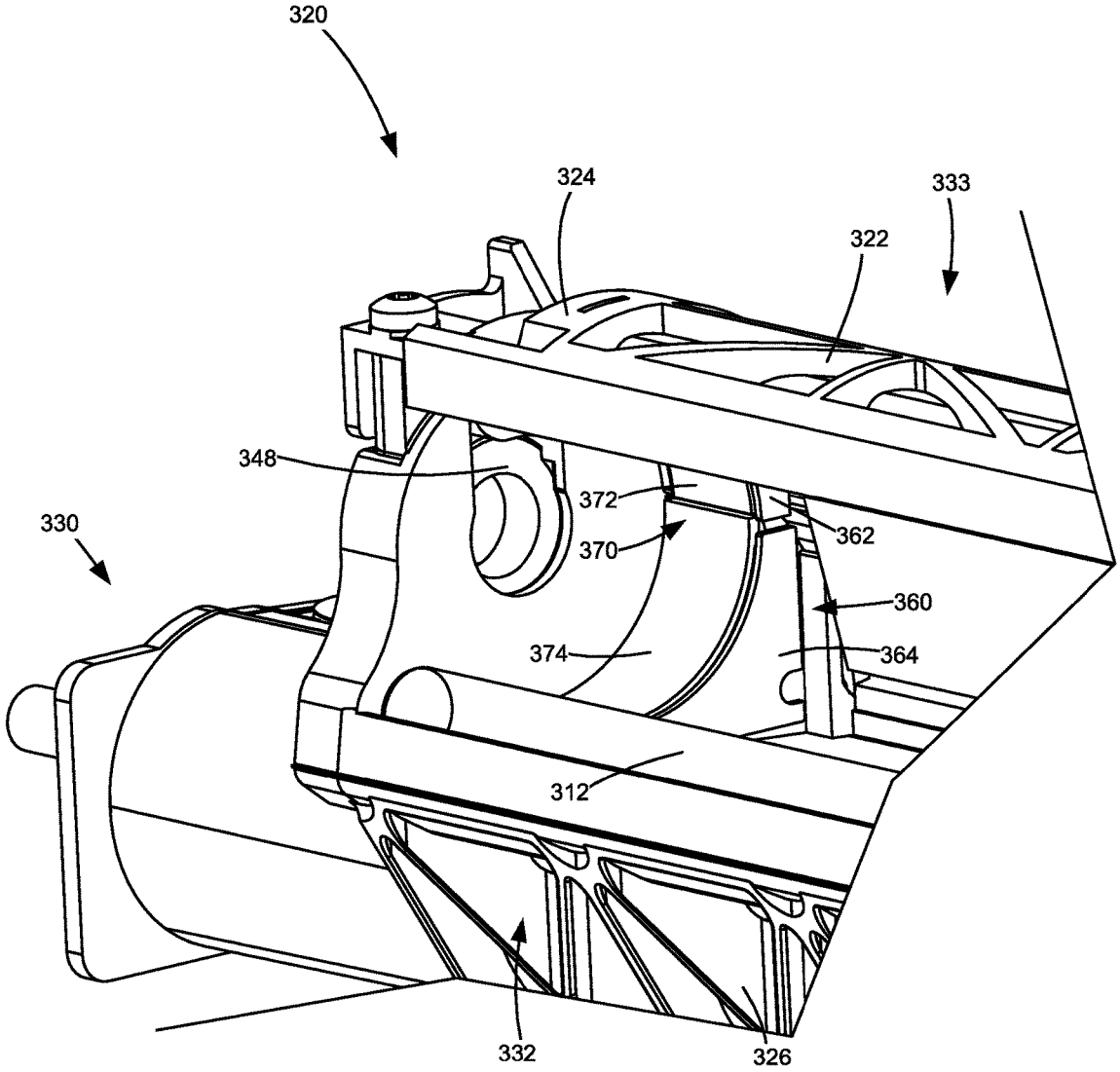
FIG. 6 is a perspective view of an end of the developer unit of FIGS. 3-5 with the developer roll removed according to one example embodiment.

FIG. 6 shows an end portion of developer unit 320 near side 330 with developer roll 306 removed to more clearly illustrate the components positioned within housing 322 near the axial end of developer roll 306. A bushing 348 is positioned at each axial end of developer roll 306 that receives a respective axial end of shaft 346. Bushings 348 locate the ends of shaft 346.

A magnetic shunt assembly 360 that axially truncates the magnetic field at the axial ends of core 342 is positioned near each axial end of sleeve 344. In the example embodiment illustrated, each shunt assembly 360 includes an upper external magnetic shunt 362 and a lower external magnetic shunt 364. However, shunt assemblies 360 may include any suitable number and arrangement of shunts. Shunts 362, 364 are positioned outside the circumference of sleeve, in close proximity to a portion of the outer surface of sleeve 344 near each axial end of sleeve 344. Shunts 362, 364 are referred to as external because they are positioned outside the circumference of sleeve 344. In some embodiments, each shunt assembly 360 includes one or more internal magnetic shunts positioned inside the circumference of sleeve 344 against the axial end of core 342. Where each shunt assembly 360 includes both external and internal shunts, it is preferred that the external and internal shunts do not overlap angularly at that axial end of developer roll 306. If an internal shunt did overlap with an external shunt, the internal shunt would tend to cancel out the magnetic field truncation of the overlapped external shunt thereby defeating the purpose of the internal and external shunts in the overlapping region.

Each shunt 362, 364 is composed of a magnetically permeable metal that pulls or redirects the magnetic field lines from the axial ends of core 342 back into core 342 to decrease the distance that the magnetic field lines extend axially past core 342. As a result, shunts 362, 364 decrease how far out axially the chains of developer mix form on the outer surface of sleeve 344. In this manner, shunts 362, 364 limit the amount of developer mix on sleeve 344 axially past the ends of core 342 and permit the use of a sleeve 344 having a smaller overall axial length as well as a charge roll 308 and PC drum 310 having smaller axial lengths. The reduction of developer mix past the axial ends of core 342 reduces the amount of toner that is inadvertently transferred to the outer axial portions of PC drum 310 beyond the axial ends of charge roll 308 thereby improving the print quality at the side margins of the printed page and improving toner yield by reducing the amount of toner lost to the outer axial portions of PC drum 310. In one embodiment, the permeability of each shunt is at least 10 times the permeability of free space and may be between 100 and 1,000 times the permeability of free space or more.

During operation, the magnetic field lines redirected by shunts 362, 364 at the axial ends of developer roll 306 cause a wall of developer mix to accumulate in the gaps between the outer surface of sleeve 344 and shunts 362, 364. The wall of developer mix forms a barrier to reduce the developer mix leaking axially outward from developer roll 306 or reservoir 302 and out of housing 322 at the axial ends of developer roll 306 during operation or in the event that developer unit 320 is dropped.

A magnetic seal assembly 370 is positioned in close proximity to a portion of the outer surface of sleeve 344 at each axial end of developer roll 306, axially outboard of the magnetic shunt assembly 360 at each axial end of developer roll 306. In the example embodiment illustrated, each seal assembly 370 includes an upper magnetic seal 372 positioned axially outboard from upper shunt 362 and a lower magnetic seal 374 positioned axially outboard from lower shunt 364. In one embodiment, a thin plastic rib separates each upper shunt 362 from each upper magnetic seal 372 and each lower shunt 364 from each lower magnetic seal 374 at each axial end of developer roll 306. Magnetic seals 372, 374 each include a permanent magnet that attracts any developer mix that leaks axially outward past shunts 362, 364 to reduce the developer mix leaking out of housing 322 at the axial ends of developer roll 306 during operation or in the event that developer unit 320 is dropped. Developer mix may tend to initially accumulate on the inner axial portions of magnetic seals 372, 374 creating a barrier that reduces the developer mix leaking further axially outward. In one embodiment, the permanent magnet of each magnetic seal 372, 374 includes a series of alternating polarity (south v. north) magnetic poles that are axially offset from each other.

With reference to FIGS. 4-6, in the example embodiment illustrated, upper shunts 362 and magnetic seals 372 are mounted on an inner surface of lid 324 proximate to the outer surface of sleeve 344 and lower shunts 364 and magnetic seals 374 are mounted on an inner surface of base 326 proximate to the outer surface of sleeve 344. Shunts 362, 364 and magnetic seals 372, 374 curve around sleeve 344 in close proximity to the outer surface of sleeve 344. In the example embodiment illustrated, a starting point 390 (with respect to the operative rotational direction of developer roll 306), or front end, of upper shunts 362 and magnetic seals 372 is positioned between transport pole 354 and release pole 355 where the magnetic field from core 342 is more tangential than radial. In one embodiment, starting point 390 of upper shunts 362 and magnetic seals 372 is positioned at about the peak tangential point of the magnetic field from core 342 between transport pole 354 and release pole 355.

An ending point 392 (with respect to the operative rotational direction of developer roll 306), or bottom end, of upper shunts 362 and magnetic seals 372 and a starting point 394 (with respect to the operative rotational direction of developer roll 306), or top end, of lower shunts 364 and magnetic seals 374 are positioned past release point 356. Ending point 392 and starting point 394 are positioned above the point where the released developer mix reenters reservoir 302 (at about the top 334 of housing 322 above auger 340*a*). As a result, the released developer mix tends to fall from sleeve 344 toward reservoir 302 as it passes ending point 392 and starting point 394, and may fall substantially vertically at about the 3:00 position of magnetic roll 306 as viewed in FIG. 5 (where the tangent to the outer surface of sleeve 344 is vertical) as it passes ending point 392 and starting point 394. In one embodiment, a small gap 366 (e.g., ~1 mm) exists between ending point 392 of each upper shunt 362 and magnetic seal 372 and starting point 394 of each lower shunt 364 and magnetic seal 374. Gaps 366 are positioned at the point where the developer mix released from sleeve 344 falls substantially vertically toward reservoir 302 at about the 3:00 position of magnetic roll 306 as viewed in FIG. 5 thereby reducing the likelihood of developer mix leaking through gap 366. Further, the magnetic fields of upper magnetic seals 372 and lower magnetic seals 374, regardless of their orientation (e.g., both north, both south, or one south and one north), tend to curve over and magnetically fill gaps 366 thereby also reducing the likelihood of leakage through gaps 366.

An ending point 396 (with respect to the operative rotational direction of developer roll 306), or front end, of lower shunts 364 and magnetic seals 374 is positioned in close proximity to trim bar 312. In one embodiment, a front end of each lower magnetic seal 374 touches the rear side of trim bar 312 to reduce leakage of developer mix between trim bars 312 and lower magnetic seal 374.

Figure 7:
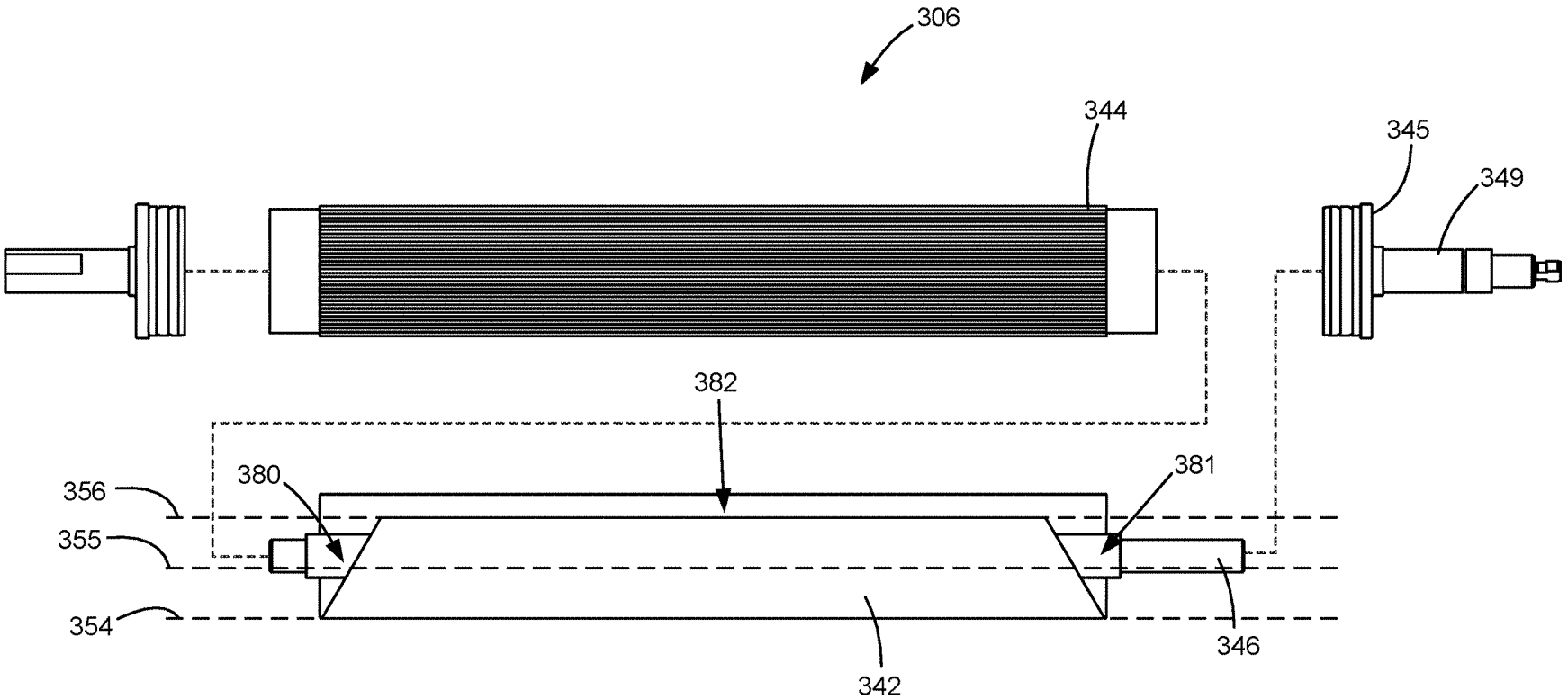
FIG. 7 is an exploded view of the developer roll showing a core of the developer roll according to one example embodiment.

FIG. 7 shows developer roll 306 according to one example embodiment with sleeve 344 separated from core 342 to more clearly illustrate the features of core 342. The axial length of the magnetized portion of core 342 decreases at both axial ends of core 342 as the magnetized portion of core 342 approaches release point 356 in the operative rotational direction of developer roll 306. In this manner, the magnetized portion of core 342 immediately prior to release point 356 is narrower in the axial dimension 307 of developer roll 306 than release pole 355, which is narrower in the axial dimension 307 than transport pole 354, such that the axial ends of the magnetized portion of core 342 immediately prior to release point 356 are inset axially from the axial ends of release pole 355, which are inset axially from transport pole 354. The magnetized portion of core 342 is the portion of core 342 that has a sufficient total magnetic field strength magnitude (generally, at least 15 mT at the outer surface of sleeve 344) to retain the developer mix against the surface of sleeve 344. FIG. 7 shows a portion of core 342 that includes transport pole 354, release pole 355 and release point 356, which are spaced circumferentially from each other from bottom to top as viewed in FIG. 7.

In the example embodiment illustrated in FIG. 7, the axial length of core 342 narrows at both axial ends of core 342 from a point just after transport pole 354 through release pole 355 to release point 356 in the operative rotational direction of developer roll 306. In this manner, the axial ends of core 342 include cutouts 380, 381 that extend axially inward from a point just after transport pole 354 through release pole 355 to release point 356 in the operative rotational direction of developer roll 306. In the embodiment illustrated, substantially all of the material of core 342 is magnetized. In this manner, the narrowing of core 342 at its axial ends provides the narrowed magnetization of core 342 at its axial ends. In the embodiment illustrated, the axial end of core 342 at release point 356 is inset axially by a few millimeters (e.g., 3.5 mm) relative to the axial end of core 342 from pickup pole 351 to transport pole 354. In the embodiment illustrated, core 342 also includes a cutout 382 along the entire axial length of core from release point 356 to a point just prior to pickup pole 351 in the operative rotational direction of developer roll 306. Cutout 382 provides a circumferential region where the magnetic field of core 342 is insufficient to hold developer mix against the surface of sleeve 344 allowing the developer mix in this region to release back into reservoir 302. In the example embodiment illustrated, core 342 includes a constant radius except for the circumferential region of cutout 382. Cutouts 380, 381 in the axial ends of core 342 and cutout 382 are also represented schematically in FIG. 5.

Cutouts 380, 381, 382 may be formed by any suitable method. For example, in one embodiment, core 342 is first formed as an extrusion with no material in the area of cutout 382 and cutouts 380 and 381 are then removed from core 342. In another embodiment, core 342 is first formed as a uniform cylinder and cutouts 380, 381, 382 are then removed from core 342. In another embodiment, core 342 is molded into a shape that includes cutouts 380, 381, 382.

In some embodiments, the axial length of the magnetized portion of core 342 decreases at the axial ends of core 342 by a constant axial distance per degree in the operative rotational direction of developer roll 306 as the magnetized portion of core 342 approaches release point 356. For example, in the example embodiment shown in FIG. 7, cutouts 380, 381 are formed in a straight line at the axial ends of core 342 such that the axial ends of core 342 narrow by a constant axial distance per degree at cutouts 380, 381. In other embodiments, the axial length of the magnetized portion of core 342 decreases at the axial ends of core 342 by an axial amount per degree that varies.

Figure 8:
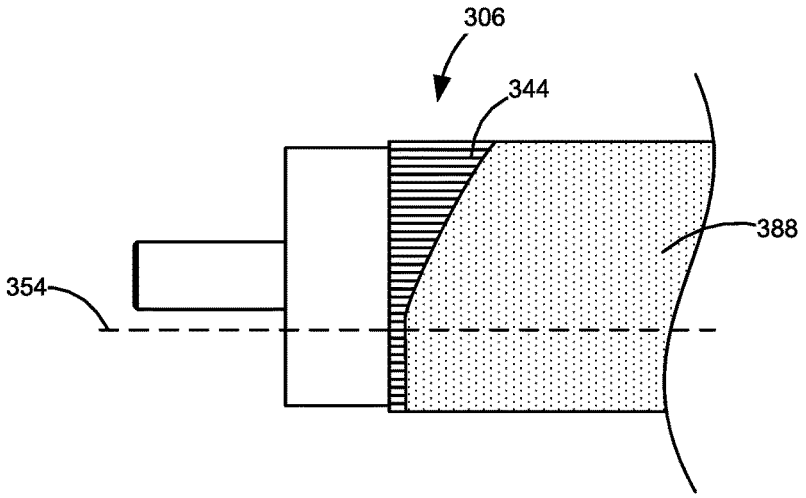
FIG. 8 is a plan view of an end portion of the developer roll of FIG. 7 showing the location of developer mix on an outer surface of a sleeve of the developer roll.

FIG. 8 shows the location of developer mix 388 on the surface of sleeve 344 at one axial end of a developer roll 306 having the core 342 shown in FIG. 7. The location of transport pole 354 is indicated by the dashed line in FIG. 8. As shown in FIG. 8, the developer mix 388 on the surface of sleeve 344 tapers axially inward due to the corresponding taper of the magnetized portion of core 342. In this manner, the chains of developer mix 388 on the surface of sleeve 344 follow the shape of cutouts 380, 381. As a result, the narrowing magnetic field moves the developer mix 388 on the surface of sleeve 344 axially inward from both ends of sleeve 344 after the developer mix 388 passes PC drum 310 during rotation of sleeve 344. The narrowing of the developer mix 388 on the surface of sleeve 344 as it approaches release point 356 reduces the axial length of the developer mix that is released from sleeve 344 back into reservoir 302. The reduced axial length of the developer mix that is released from sleeve 344 into reservoir 302 helps keep the released developer mix axially inward from shunts 362, 364 and magnetic seals 372, 374, which reduces the risk of contaminating magnetic seals 372, 374 with developer mix. If too much developer mix is attracted to the surfaces of magnetic seals 372, 374, magnetic seals 372, 374 may no longer be able to contain additional developer mix that leaks axially outward past shunts 362, 364. Contamination of magnetic seals 372, 374 also increases the torque required to drive developer roll 306 and imparts additional wear on the carrier beads, which reduces the useful life of the carrier beads.

Figure 9:
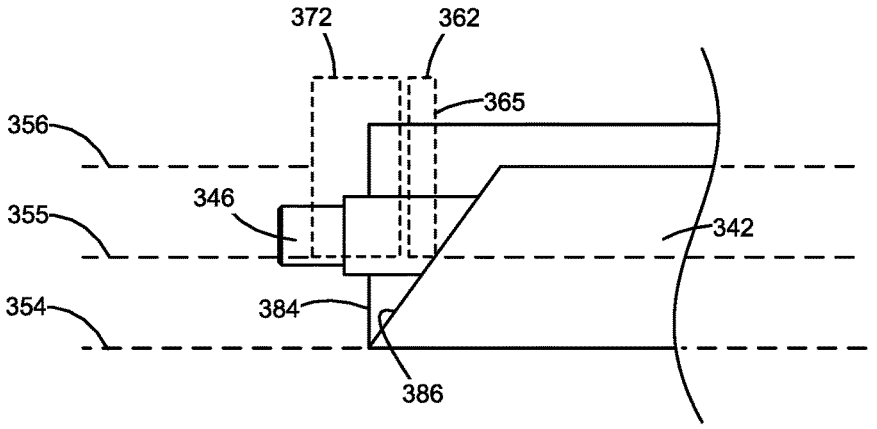
FIG. 9 is a plan view of an end portion of the core of the developer roll of FIGS. 7 and 8 schematically showing the positions of a magnetic shunt and a magnetic seal relative to the core according to one example embodiment.

FIG. 9 shows one axial end of the core 342 shown in FIG. 7 with the positions of magnetic shunt 362 and magnetic seal 372 relative to core 342 illustrated schematically in dashed lines according to one example embodiment. In some embodiments, inner axial ends 365 of shunts 362 are positioned either axially in line with an outermost axial end 384 of the magnetized portion of core 342, which is the axial end of core 342 from pickup pole 351 to transport pole 354 in the embodiment illustrated, or axially between the outermost axial end 384 of the magnetized portion of core 342 and the axial end 386 of the magnetized portion of core 342 immediately prior to release point 356. In some embodiments, an inner axial end 365 of each shunt 362 is positioned axially within a range of even with the outermost axial end of core 342, which is the portion of core 342 from pickup pole 351 to transport pole 354 in the embodiment illustrated, to 3 mm axially inboard from the outermost axial end of core 342 (i.e., an axial position of 0 mm to −3 mm relative to the outermost axial end of core 342). It is normally desired to position the magnetic shunt(s) axially outboard of the outermost axial end of the core to reduce the risk of contaminating the magnetic seal(s) with developer mix. However, the reduced axial length of the developer mix that is released from sleeve 344 into reservoir 302 due to the narrowing magnetic field of core 342 allows shunts 362 to be positioned inboard of the outermost axial end of core 342 without contaminating the magnetic seal(s). Shifting the magnetic shunts 362 and seals 372 axially inward may, in turn, aid in reducing the length of developer unit 320 in the axial dimension 307. In some embodiments, shunts 364 and seals 374 are positioned axially outboard of the outermost axial end 384 of the magnetized portion of core 342.

Figure 10:
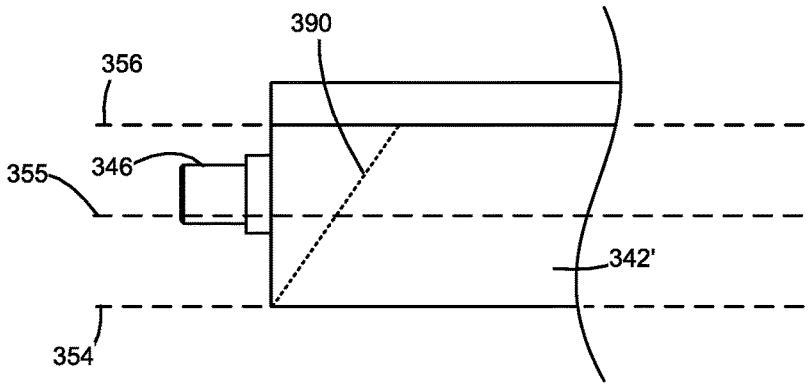
FIG. 10 is a plan view of the core of the developer roll according to another example embodiment.

FIG. 10 shows a core 342' of developer roll 306 according to another example embodiment. Like core 342 discussed above with respect to FIGS. 7-9, the axial length of the magnetized portion of core 342' decreases at both axial ends of core 342' as the magnetized portion of core 342' approaches release point 356 in the operative rotational direction of developer roll 306. However, instead of cutouts 380, 381, the portion of core 342' that is sufficiently magnetized to retain the developer mix against the surface of sleeve 344 simply narrows from a point just after transport pole 354 to release point 356 in the operative rotational direction of developer roll 306 as indicated by dashed line 390 in FIG. 10. That is, the axial ends of core 342' are uniform from pickup pole 351 to release point 356 in the operative rotational direction of developer roll 306 but a portion of the material of core 342' at each axial end between transport pole 354 and release point 356 is not sufficiently magnetized to retain the developer mix against the surface of sleeve 344. As discussed above, the axial length of the magnetized portion of core 342' at the axial ends of core 342' may decrease by a constant axial distance per degree or an axial distance per degree that varies in the operative rotational direction of developer roll 306 as the magnetized portion of core 342' approaches release point 356. Similarly, cutout 382 may be replaced with a corresponding portion of the material of core 342' between release point 356 and pickup pole 351 that is not sufficiently magnetized to retain the developer mix against the surface of sleeve 344.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for a dual component development electrophotographic image forming device, comprising:

a housing having a reservoir for storing a developer mix that includes toner and magnetic carrier beads; and a developer roll mounted on the housing, the developer roll includes a stationary core and a cylindrical sleeve positioned around the core, the core includes at least one permanent magnet forming a magnetized portion of the core that includes a plurality of circumferentially spaced magnetic poles, the plurality of magnetic poles includes a release pole, the sleeve is rotatable relative to the core about an axis of rotation in an operative rotational direction, the core includes a pair of axial ends relative to the axis of rotation, an outer circumferential surface of the sleeve is positioned to transport developer mix magnetically attracted from the reservoir to the outer surface of the sleeve by the magnetized portion of the core in the operative rotational direction, the release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir, wherein an axial length of the magnetized portion of the core decreases at both axial ends of the core as the magnetized portion of the core approaches the release point in the operative rotational direction, wherein a portion of the developer roll is exposed from the reservoir to permit transfer of toner from the outer circumferential surface of the sleeve to a photoconductive drum and the axial length of the magnetized portion of the core decreases at both axial ends of the core beginning downstream from a point where toner transfers from the outer circumferential surface of the sleeve to the photoconductive drum in the operative rotational direction.

2. The developer unit of claim 1, wherein the axial length of the magnetized portion of the core decreases at both axial ends of the core from the release pole to the release point in the operative rotational direction.

3. The developer unit of claim 1, wherein axial ends of the magnetized portion of the core immediately prior to the release point are axially inset from axial ends of the magnetized portion of the core at a transport pole of the plurality of magnetic poles that immediately precedes the release pole in the operative rotational direction.

4. The developer unit of claim 1, wherein an axial length of the core decreases at both axial ends of the core as the core approaches the release point in the operative rotational direction.

5. A developer unit for a dual component development electrophotographic image forming device, comprising:

a housing having a reservoir for storing a developer mix that includes toner and magnetic carrier beads; and a developer roll mounted on the housing, the developer roll includes a stationary core and a cylindrical sleeve positioned around the core, the core includes at least one permanent magnet forming a magnetized portion of the core that includes a plurality of circumferentially spaced magnetic poles, the plurality of magnetic poles includes a release pole, the sleeve is rotatable relative to the core about an axis of rotation in an operative rotational direction, the core includes a pair of axial ends relative to the axis of rotation, an outer circumferential surface of the sleeve is positioned to transport developer mix magnetically attracted from the reservoir to the outer surface of the sleeve by the magnetized portion of the core in the operative rotational direction, the release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir, wherein an axial length of the magnetized portion of the core decreases at both axial ends of the core as the magnetized portion of the core approaches the release point in the operative rotational direction, further comprising a shunt positioned at each axial end of the core, each shunt is composed of a magnetically permeable metal that redirects a magnetic field of the at least one permanent magnet at a respective axial end of the core, each shunt is positioned outside of a circumference of the sleeve and in close proximity to the outer circumferential surface of the sleeve from the release pole to the release point, an inner axial end of each shunt is positioned axially in line with a respective outermost axial end of the magnetized portion of the core or axially between the respective outermost axial end of the magnetized portion of the core and a respective axial end of the magnetized portion of the core immediately prior to the release point.

6. The developer unit of claim 5, further comprising a magnetic seal positioned at each axial end of the core, each magnetic seal is positioned axially outboard of the respective shunt at the axial end of the core where said magnetic seal is positioned, each magnetic seal is positioned outside of the circumference of the sleeve and in close proximity to the outer circumferential surface of the sleeve from the release pole to the release point, each magnetic seal includes a permanent magnet that attracts developer mix to the respective magnetic seal.

7. A developer roll for transporting a developer mix that includes magnetic carrier beads and toner in a dual component development electrophotographic image forming device, comprising:

a core including at least one permanent magnet forming a magnetized portion of the core that includes a plurality of circumferentially spaced magnetic poles generating a magnetic field, the plurality of magnetic poles includes a release pole; and a cylindrical sleeve positioned around the core, the sleeve is rotatable relative to the core about an axis of rotation in an operative rotational direction, the core includes a pair of axial ends relative to the axis of rotation, wherein the release pole is positioned to magnetically attract developer mix to an outer circumferential surface of the sleeve to transport the developer mix on the outer circumferential surface of the sleeve in the operative rotational direction when the sleeve rotates relative to the core to a release point where a magnitude of a total magnetic field strength of the magnetic field falls below 15 mT at the outer circumferential surface of the sleeve, wherein an axial length of the magnetized portion of the core decreases at both axial ends of the core as the magnetized portion of the core approaches the release point in the operative rotational direction, wherein the axial length of the magnetized portion of the core decreases at both axial ends of the core beginning downstream from a transport pole of the plurality of magnetic poles that immediately precedes the release pole in the operative rotational direction.

8. The developer roll of claim 7, wherein the axial length of the magnetized portion of the core decreases at both axial ends of the core from the release pole to the release point in the operative rotational direction.

9. The developer roll of claim 7, wherein an axial length of the core decreases at both axial ends of the core as the core approaches the release point in the operative rotational direction.

10. A developer roll for transporting a developer mix that includes magnetic carrier beads and toner in a dual component development electrophotographic image forming device, comprising:

a core including at least one permanent magnet forming a magnetized portion of the core that includes a plurality of circumferentially spaced magnetic poles generating a magnetic field, the plurality of magnetic poles includes a release pole; and a cylindrical sleeve positioned around the core, the sleeve is rotatable relative to the core about an axis of rotation in an operative rotational direction, the core includes a pair of axial ends relative to the axis of rotation, wherein the release pole is positioned to magnetically attract developer mix to an outer circumferential surface of the sleeve to transport the developer mix on the outer circumferential surface of the sleeve in the operative rotational direction when the sleeve rotates relative to the core to a release point where the magnetic field is insufficient to retain developer mix against the outer circumferential surface of the sleeve, wherein an axial length of the magnetized portion of the core decreases at both axial ends of the core as the magnetized portion of the core approaches the release point in the operative rotational direction, wherein the axial length of the magnetized portion of the core decreases at both axial ends of the core beginning downstream from a transport pole of the plurality of magnetic poles that immediately precedes the release pole in the operative rotational direction.

11. The developer roll of claim 10, wherein the axial length of the magnetized portion of the core decreases at both axial ends of the core from the release pole to the release point in the operative rotational direction.

12. The developer roll of claim 10, wherein an axial length of the core decreases at both axial ends of the core as the core approaches the release point in the operative rotational direction.

13. A developer unit for a dual component development electrophotographic image forming device, comprising:

a housing having a reservoir for storing a developer mix that includes toner and magnetic carrier beads; and a developer roll mounted on the housing, the developer roll includes a stationary core and a cylindrical sleeve positioned around the core, the core includes at least one permanent magnet forming a magnetized portion of the core that includes a plurality of circumferentially spaced magnetic poles, the plurality of magnetic poles includes a release pole, the sleeve is rotatable relative to the core about an axis of rotation in an operative rotational direction, the core includes a pair of axial ends relative to the axis of rotation, an outer circumferential surface of the sleeve is positioned to transport developer mix magnetically attracted from the reservoir to the outer surface of the sleeve by the magnetized portion of the core in the operative rotational direction, the release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir, wherein an axial length of the magnetized portion of the core decreases at both axial ends of the core as the magnetized portion of the core approaches the release point in the operative rotational direction, wherein the axial length of the magnetized portion of the core decreases at both axial ends of the core beginning downstream from a transport pole of the plurality of magnetic poles that immediately precedes the release pole in the operative rotational direction.

14. A developer unit for a dual component development electrophotographic image forming device, comprising:

a housing having a reservoir for storing a developer mix that includes toner and magnetic carrier beads; and a developer roll mounted on the housing, the developer roll includes a stationary core and a cylindrical sleeve positioned around the core, the core includes at least one permanent magnet forming a magnetized portion of the core that includes a plurality of circumferentially spaced magnetic poles, the plurality of magnetic poles includes a release pole, the sleeve is rotatable relative to the core about an axis of rotation in an operative rotational direction, the core includes a pair of axial ends relative to the axis of rotation, an outer circumferential surface of the sleeve is positioned to transport developer mix magnetically attracted from the reservoir to the outer surface of the sleeve by the magnetized portion of the core in the operative rotational direction, the release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir, wherein an axial length of the magnetized portion of the core decreases at both axial ends of the core as the magnetized portion of the core approaches the release point in the operative rotational direction, wherein axial ends of the magnetized portion of the core immediately prior to the release point are axially inset from axial ends of the magnetized portion of the core at the release pole.

15. A developer unit for a dual component development electrophotographic image forming device, comprising:

a housing having a reservoir for storing a developer mix that includes toner and magnetic carrier beads; and a developer roll mounted on the housing, the developer roll includes a stationary core and a cylindrical sleeve positioned around the core, the core includes at least one permanent magnet forming a magnetized portion of the core that includes a plurality of circumferentially spaced magnetic poles, the plurality of magnetic poles includes a release pole, the sleeve is rotatable relative to the core about an axis of rotation in an operative rotational direction, the core includes a pair of axial ends relative to the axis of rotation, an outer circumferential surface of the sleeve is positioned to transport developer mix magnetically attracted from the reservoir to the outer surface of the sleeve by the magnetized portion of the core in the operative rotational direction, the release pole is positioned to magnetically attract developer mix to the outer circumferential surface of the sleeve to transport developer mix on the outer circumferential surface of the sleeve in the operative rotational direction to a release point where the developer mix releases from the outer circumferential surface of the sleeve back into the reservoir, wherein an axial length of the magnetized portion of the core decreases at both axial ends of the core as the magnetized portion of the core approaches the release point in the operative rotational direction, wherein the axial length of the magnetized portion of the core decreases at both axial ends of the core by a constant axial distance per degree as the magnetized portion of the core approaches the release point in the operative rotational direction.

16. The developer unit of claim 5, wherein the inner axial end of each shunt is positioned axially between the respective outermost axial end of the magnetized portion of the core and the respective axial end of the magnetized portion of the core immediately prior to the release point.

17. A developer roll for transporting a developer mix that includes magnetic carrier beads and toner in a dual component development electrophotographic image forming device, comprising:

a core including at least one permanent magnet forming a magnetized portion of the core that includes a plurality of circumferentially spaced magnetic poles generating a magnetic field, the plurality of magnetic poles includes a release pole; and a cylindrical sleeve positioned around the core, the sleeve is rotatable relative to the core about an axis of rotation in an operative rotational direction, the core includes a pair of axial ends relative to the axis of rotation, wherein the release pole is positioned to magnetically attract developer mix to an outer circumferential surface of the sleeve to transport the developer mix on the outer circumferential surface of the sleeve in the operative rotational direction when the sleeve rotates relative to the core to a release point where a magnitude of a total magnetic field strength of the magnetic field falls below 15 mT at the outer circumferential surface of the sleeve, wherein an axial length of the magnetized portion of the core decreases at both axial ends of the core as the magnetized portion of the core approaches the release point in the operative rotational direction, wherein the axial length of the magnetized portion of the core decreases at both axial ends of the core by a constant axial distance per degree as the magnetized portion of the core approaches the release point in the operative rotational direction.

18. A developer roll for transporting a developer mix that includes magnetic carrier beads and toner in a dual component development electrophotographic image forming device, comprising:

a core including at least one permanent magnet forming a magnetized portion of the core that includes a plurality of circumferentially spaced magnetic poles generating a magnetic field, the plurality of magnetic poles includes a release pole; and a cylindrical sleeve positioned around the core, the sleeve is rotatable relative to the core about an axis of rotation in an operative rotational direction, the core includes a pair of axial ends relative to the axis of rotation, wherein the release pole is positioned to magnetically attract developer mix to an outer circumferential surface of the sleeve to transport the developer mix on the outer circumferential surface of the sleeve in the operative rotational direction when the sleeve rotates relative to the core to a release point where the magnetic field is insufficient to retain developer mix against the outer circumferential surface of the sleeve, wherein an axial length of the magnetized portion of the core decreases at both axial ends of the core as the magnetized portion of the core approaches the release point in the operative rotational direction, wherein the axial length of the magnetized portion of the core decreases at both axial ends of the core by a constant axial distance per degree as the magnetized portion of the core approaches the release point in the operative rotational direction.

* * * * *